United States Patent [19]

Tracy

[11] 4,364,568

[45] Dec. 21, 1982

[54] METHOD OF PLAYING A STRATEGY GAME

[76] Inventor: George T. Tracy, 1515 S. Park Dr., Santa Ana, Calif. 92707

[21] Appl. No.: 146,483

[22] Filed: May 5, 1980

[51] Int. Cl.[3] ..... A63F 3/00; A63F 3/02

[52] U.S. Cl. ..... 273/242; 273/284; 273/261

[58] Field of Search ..... 273/260, 261, 262, 284, 273/242

[56] References Cited

U.S. PATENT DOCUMENTS

| | | | |
|---|---|---|---|
| 1,030,521 | 6/1912 | Maxim | 273/260 |
| 1,683,860 | 9/1928 | Cahill | 273/260 |
| 1,772,583 | 8/1930 | Barrett | 273/260 |
| 3,186,716 | 6/1965 | Shaborik . | |
| 3,399,895 | 9/1968 | Beach | 273/241 |
| 3,649,023 | 3/1972 | Schohn | 273/271 |
| 3,663,021 | 5/1972 | Whippo | 273/152.2 |
| 3,806,125 | 4/1974 | Bialek | 273/260 |
| 3,871,657 | 3/1975 | Lorenz et al. . | |
| 3,918,715 | 11/1975 | Puglisi | 273/260 X |
| 4,071,245 | 1/1978 | Kendrick | 273/243 |
| 4,079,941 | 3/1978 | Morales | 273/260 |
| 4,101,131 | 7/1978 | Barnby . | |
| 4,108,438 | 8/1978 | Rackman . | |
| 4,126,315 | 11/1978 | Tung . | |
| 4,129,304 | 12/1978 | Mager . | |
| 4,131,283 | 12/1978 | Havlik . | |
| 4,146,233 | 3/1979 | Musolino . | |

*Primary Examiner*—Richard C. Pinkham
*Assistant Examiner*—Scott Brown
*Attorney, Agent, or Firm*—Lyon & Lyon

[57] ABSTRACT

A game wherein a plurality of playing pieces are moved upon a game board grid by opposing players until one player has captured a pre-selected number of the opponent's playing pieces. The game board has an elevated border surrounding a central recessed area. A plurality of space pieces fit interchangeably within the recessed area to obtain variable and distinct playing patterns. Each space is one of a number of colors, one color being designated as a neutral color. The playing pieces are segregated into bumping pieces and jumping pieces. One of each such piece is correspondingly colored to the colors of the space pieces. The pieces are moved about the board, singly or in stacks of any size and configuration to any adjacent unoccupied space, or if an adjacent space is of the neutral color, to any unoccupied space which may be reached through any number of connected, unoccupied neutral spaces. Capture is made by bumping or jumping; a bumping piece bumping onto a similarly colored adjacent space presently occupied by opponent's piece or stack; or a jumping piece jumping over an adjacent space presently occupied by opponent's piece or stack into a space the same color as the jumping piece. Pieces of the neutral color may jump and bump onto any color space, and any color piece may jump or bump onto a space of the neutral color.

17 Claims, 5 Drawing Figures

METHOD OF PLAYING A STRATEGY GAME

BACKGROUND OF THE INVENTION

The invention relates to a chess or checkers-like game wherein a plurality of playing pieces are moved about a game board to capture the playing pieces of an opponent. The invention more particularly relates to such a game wherein a plurality of spaces may be randomly placed on a game board to obtain interchangeable, variable, plural and distinct playing patterns within a constant grid or plan.

There are numerous games wherein playing pieces are moved about a game board. These games range from the very simple checkers, to the more complex chess. Many such games, however, because of their simplicity, do not appeal to a wide range of ages and lose their appeal after a certain period of play. The more complex games, while being more challenging, suffer from being difficult to learn and from a limited cross-section of the public to which the game appeals. It is therefore desirable to develop a game which has easily learnable basic moves, yet provides sufficient comlexity and subtlety to appeal not only to the youngster, but also to older, more sophisticated persons. The present invention provides such a game.

SUMMARY OF INVENTION

This invention relates to a strategy game involving a game board upon which playing pieces move in a specified manner, the opponents attempting to capture the playing pieces of one another. The game board has a constant grid or plan, within which color coded spaces are interchangeable to provide for a plurality of variable and distinct playing patterns. The playing pieces are also color coded, their colors corresponding to the colors of the spaces within the playing pattern. A number of the spaces of the playing pattern are a neutral color, such as white. The playing pieces, segregated into an equal number of jumping and bumping pieces, begin from designated starting spaces and may be moved, either singly or in stacks, to any adjacent, unoccupied space, or, if an adjacent space is of the neutral color, to any unoccupied space which may be reached by moving the piece through that or any number of connected, unoccupied neutral spaces. By adjacent is meant any of the eight spaces which surround any one space. The pieces of the opponent may be captured by either jumping, with a jumping piece, the space upon which the opponent's pieces are located, or by bumping, with a bumping piece, the opponent's pieces by moving a piece or stack onto the space presently occupied by the opponent's piece or stack. The jump or bump may only be completed to a square of the same color as the jumping or bumping piece, or to a neutral space. The top piece of a stack dictates the color of that stack. One of the bumping pieces and one of the jumping pieces are the same color as the neutral color. These pieces may bump or jump onto any color space. The method of playing may be changed to accomodate those who have become proficient with the game and desire a larger array of potential moves, by allowing a jump or a bump to be executed after passing through any number of connected, unoccupied neutral spaces; and further, by allowing a move to consist of flipping over a stack such that the color of the bottom pieces of a stack thereby becomes the controlling color.

The game board itself has an elevated border about a central recessed area. Three stationary spaces are provided on each corner of the recessed area. The recessed area provides the plan into which the space pieces may be interchangeably arranged to provide, with the stationary spaces on the elevated border, the playing grid. The recessed area is designed and constructed to present a flat playing area when the space pieces are inserted into the recessed area.

It is the object of this invention to provide a method of play for a strategy game, which game is easy to learn, yet provides sufficient complexity and subtlety to appeal to a broad range of persons.

It is another object of this invention to provide a game wherein the playing pattern may be varied within a constant grid to provide a plurality of distinct playing patterns.

It is another object of the present invention to provide a game wherein the method of play may be altered slightly to provide additional complexity and subtlety as the players acquire expertise.

Other and further objects and advantages of the present invention will be apparent to those skilled in the art upon a review of the following Figures, Description, and Claims.

DESCRIPTION OF THE PREFERRED EMBODIMENT

Figure 1:
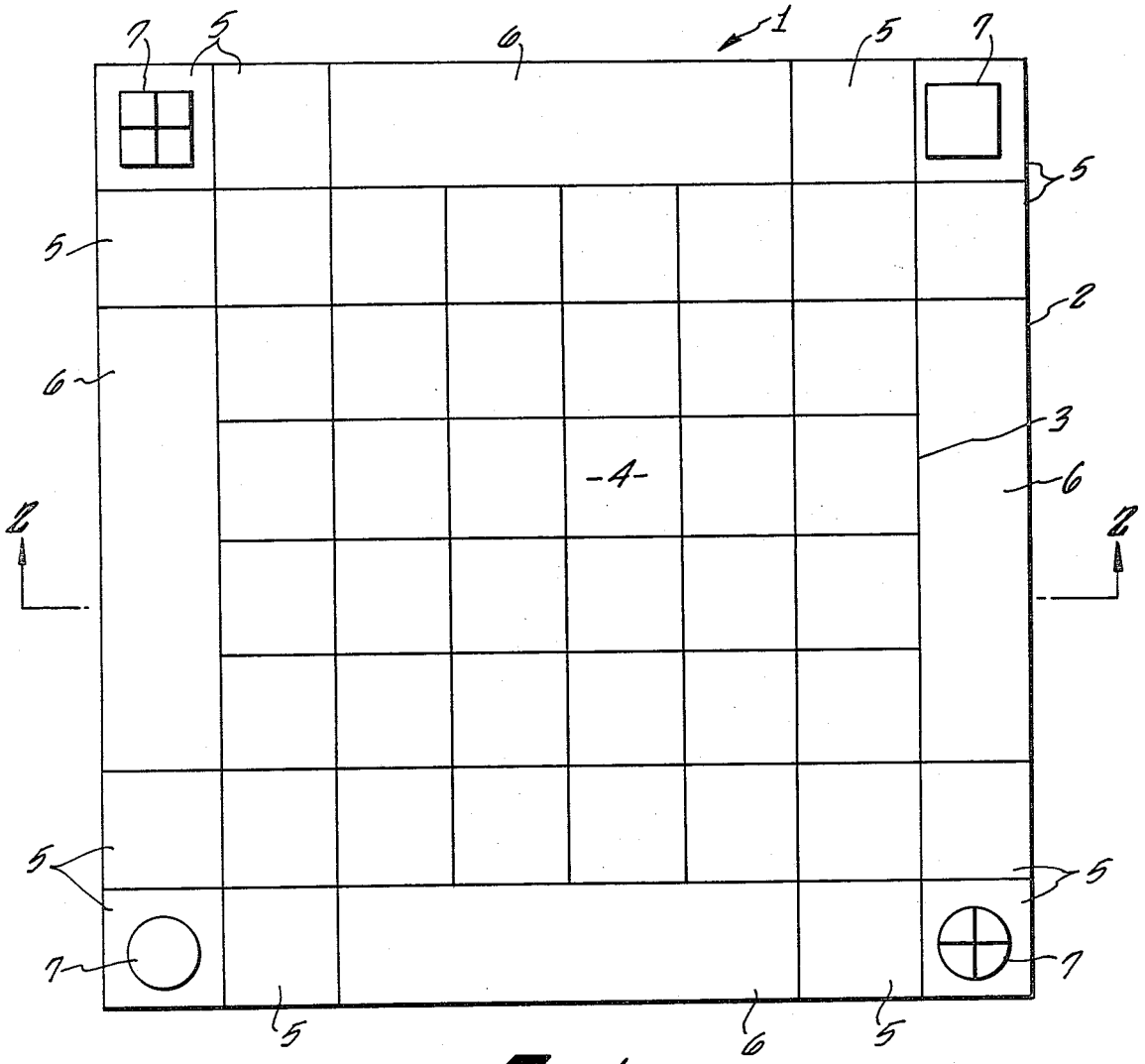
FIG. 1 is a plan view of the game board, showing playing grid.
Figure 2:
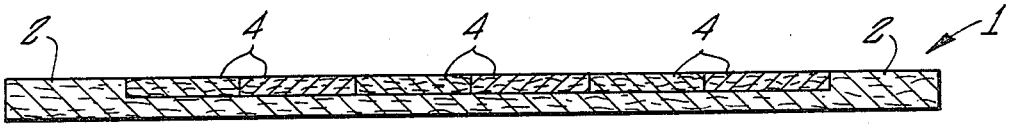
FIG. 2 is a side view of the game board showing the recessed area and the manner in which the space pieces fit therein.
Figure 3:
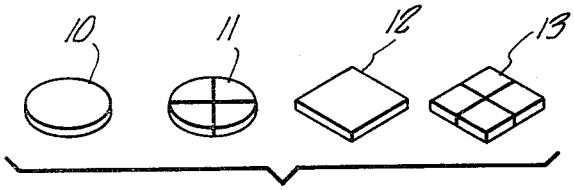
FIG. 3 shows the design of the various playing pieces.
Figure 4:
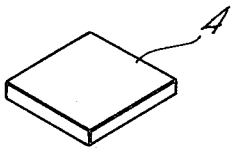
FIG. 4 is a perspective view of a space piece.

The game board of the present invention may be constructed out of any durable material. A rigid, heavy weight paper material is suitable. The game board, generally designated 1, has an elevated border 2 surrounding a central recessed area 3. The amount that central area 3 is recessed is equal to the height of space pieces 4, such that when space pieces 4 are placed in recessed area 3, a flat surface for the game board is produced. Space pieces 4 are small squares, their size being such that a plurality of space pieces 4 snugly fit within central recessed area 3 of game board 1. On the border 2 of game board 1 three spaces 5 are indicated adjacent to each corner of central recessed area 3. In this manner, when all space pieces 4 are placed within central recessed area 3, the playing grid is complete, consisting of the plurality of space pieces within recessed central area 3 and the twelve additional spaces 5 which are drawn onto game board 1. It will be noted that each space piece 4 is interchangeable with every other space piece 4, such that the arrangement of space pieces 4 within central recessed area 3 may be varied within a plurality of distinct playing patterns. Separating the spaces 5 on border 2 are four void spaces 6. The corner most spaces of border 2 are designated starting spaces 7. Each one of the four designated starting spaces 7 depict one of the playing pieces, which pieces are shown in FIG. 3. The importance of each playing piece will be explained infra.

Each of the space pieces 4 have one of a plurality of colors. In the preferred embodiment, there are five such colors. There are an equal number of space pieces 4 of each of four of said colors. The fifth color is designated a neutral color. There are, in the preferred embodiment, half as many space pieces of the neutral color within central recessed area 3 as there are of each of the other four colors. Each of the border spaces 5 is also of the neutral color. The importance of the color coding will become apparent when the method of play is described below.

Turning now to the playing pieces as shown in FIG. 3, the playing pieces are divided into two equal groups, the first group comprising round playing pieces 10 and 11 while the second group comprises square playing pieces 12 and 13. These groups are allotted one each to the two opponents, so that one opponent has all round pieces, while the other opponent has all square pieces. Each group is further divided into two equal subgroups. One such subgroup is designated as jumping pieces 10 and 12 while the other subgroup is bumping pieces 11 and 13. The importance of these designations will be explained infra. There are an equal number of pieces within each subgroup. The various designated starting spaces 7 are coded corresponding to one said subgroup.

Turning now to the method of play, the first step is to randomly place the interchangeable space pieces 4 into the central recessed area 3 of the game board 1. The playing pattern is thereby established. One player receives the round playing pieces while the other player receives the square playing pieces. Each player then divides his pieces into the separate subgroups, first subgroup is comprised of circular jumping pieces 10. The second subgroup is comprised of circular bumping pieces 11. The opponent has corresponding square jumping pieces 12 and square bumping pieces 13. The pieces 10, 11, 12 and 13 are each color coded, one each to each of the colors of space pieces 4 and the neutral color.

The next step involves each player segregating his pieces into the two subgroups. Formed into a stack, these playing pieces are positioned onto the similarly coded designated starting spaces 7. After the players have determined by some agreeable means who is to move first, that player may move any number of pieces of any one stack to any adjacent unoccupied space, or, if an adjacent space is an unoccupied neutral space, any unoccupied space which may be reached by moving through any number of unoccupied, connected neutral spaces. A stack of pieces may be broken; that is, moving only a portion of a stack in any one move; or a stack may be built by moving a piece to a space occupied by the player's own piece or pieces. A stack may be built of both bumping and jumping pieces.

The object of the game is to capture the opposing player's pieces. A capture may be made by jumping the opponent's piece or stack, or by bumping an opponent's piece or stack. The top piece of a stack controls the movement of that stack. That is, if the top piece of a stack is a red jumping piece, then the entire stack is treated as a red jumping piece. A jump may be made when the player's jumping piece, or stack of which the top piece is a jumping piece, jumps over the piece or stack of the opponent, which piece or stack is situated in a playing space adjacent to that in which the player's piece or stack is situated, to an unoccupied playing space, which playing space is of the same color as the jumping piece. Mutiple jumps may be made. A bump occurs when the player's bumping piece, or stack of which the top piece is a bumping piece, moves onto an adjacent space of the same color, occupied by an opponent's piece of stack. Multiple bumps may not be made. The jumping or bumping piece which is of the neutral color may jump or bump into or onto any color space. Any color jumping or bumping piece may jump or bump onto any space of the neutral color. This continues until one player has captured a pre-determined number of his opponent's pieces.

The method of play may be modified to provide for greater complexity and subtlety by allowing a player, in lieu of moving, jumping or bumping a piece or stack, to flip a stack, such that the bottom piece then becomes the top piece. Another modification to increase the complexity and subtlety of the game, is to allow a bump to be made after sliding through any number of connected, unoccupied neutral spaces.

Figure 5:
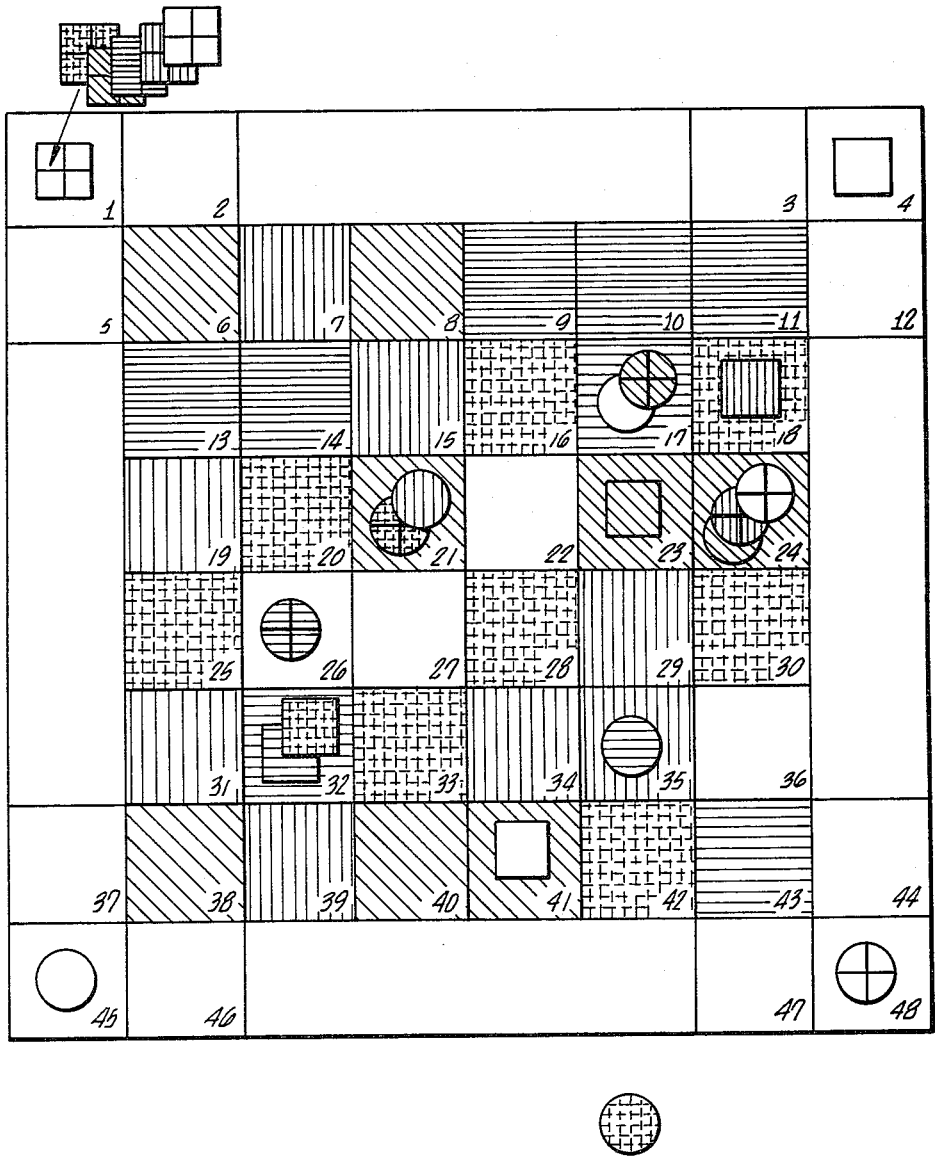
FIG. 5 is a plan view of the game board, with playing pieces placed thereon. The colors of the space pieces and resulting playing pattern as may be obtaind by the random placement of the space pieces within the recessed area of the game board are shown.

To better understand the method of play, FIG. 5 shows the game board and playing pieces arranged thereon in a game situation. The various spaces are numbered, and are colored to aid in describing the possible moves which each piece or stack may make.

Space 1 is the designated space for the square bumping pieces 13. The entire stack, the top four pieces, the top three pieces, the top two pieces or the top piece alone could move to any one of the following spaces: 2, 5, 6, 7, or 13. The stack on space 17 is controlled by a green bumping piece. The entire stack, or the green bumping piece alone could move to any one of the following spaces: 9, 10, 11, 15, 16, 20, 21, 22, 24, 26, 27, 28, 29, 33, or 34. It could also capture the square green jumping piece on space 23. The red square jumping piece on space 18 could move to any one of the following spaces: 3, 4, 10, 11, 12, or 23 to build the stack with a piece already there. The stack on space 21 is controlled by the round red jumping piece. The entire stack or the red jumping piece alone could move to any one of the following spaces: 14, 15, 16, 17, 20, 22, 26, 27, 28, 29, 33, or 34. The square green jumping piece on space 23 could move to any one of the following spaces: 15, 16, 18, 20, 22, 27, 28, 29, 30, 32, 33, 34. The stack on space 24 is controlled by a bumping piece of the neutral color. The entire stack, top two pieces or the top piece alone could move to any one of the following spaces: 17, 29, or 30. It could also capture the square red jumping piece on space 18 or the square green jumping piece on space 23. The round blue bumping piece on space 26 could move to any one of the following spaces: 15, 16, 17, 19, 20, 21, 22, 25, 27, 28, 29 31, 33, or 34. It could also capture the stack on space 32 by bumping into that space. The stack on space 32 is controlled by the square yellow jumping piece. The entire stack or the top piece alone could move to any one of the following spaces: 15, 16, 20, 22, 23, 25, 27, 28, 29, 31, 33, 34, 38, 39, or 40. It may also capture the round blue bumping piece on space 26 and the round red jumping piece/round yellow bumping piece stack on space 21 by making a mulitple jump first to space 20 and then onto space 22 as multiple jumps are allowed providing the jumps comply with the above described method of play. The round blue jumping piece on space 35 may move to any one of the following spaces: 28, 29, 30, 34, 36, 42, 43, 44, 47 or 48. The square jumping piece of the neutral color on space 41 could move to any one of the following spaces: 33, 34, 40 or 42. It could also capture the blue jumping piece on space 35 by jumping to space 30. Under the modified rules, the stack on space 17 could be flipped so that the round bumping piece of the neutral color was placed on top of the green jumping piece, and on the next move, that stack or the top bumping piece alone could slide through space 22 and through space 27 to bump the stack of square pieces on space 32.

Thus, an improved strategy game and method of play have been disclosed. It will be apparent to those skilled in the art that many modifications of the preferred embodiment herein described may be developed without departing from the inventive concepts of this game. Therefore, the invention is not to be limited by this description, but is of the full breadth and scope of the appended claims.

What is claimed is:

1. A method of play of a strategy board game wherein each player moves his playing pieces, each piece having one of a number of distinct codes, one code being designated a neutral code, about a pattern of playing spaces, each space also having one of those codes, including said neutral code, in an attempt to capture the playing pieces of his opponent, the method of play comprising the steps of:

(a) each player receiving an identical set of coded playing pieces;

(b) each player placing his playing pieces on one or more designated starting spaces;

(c) each player, then, in alternating turns, moving one of his playing pieces, as follows:

(i) in any direction from its initial location on a designated starting space, or its other subsequent location, to any adjacent, unoccupied space;

(ii) if any space adjacent to the player's piece is occupied by an opponent's playing piece, and if the playing space directly and linearly behind (relative to the player's piece) the playing space occupied by the opponent's playing piece is unoccupied and is coded similarly to that of the player's playing piece, or if either the player's piece or said space is of the neutral code, then capturing the opponent's playing piece by linearly jumping that piece into the unoccupied playing space behind it and removing the opponent's piece from the board;

(iii) if any space adjacent to the player's piece is occupied by an opponent's playing piece, and if that adjacent space is coded similarly to that of the player's playing piece, or if either the player's piece or the adjacent space is of the neutral code, then capturing the opponent's playing piece by bumping onto that playing space and removing the opponent's playing piece from the board;

(d) continuing in this manner until one player captures, either by jumping or bumping, a predetermined number of the other player's playing pieces.

2. The method of play of claim 1 which includes as an additional step, if any playing space adjacent to the space presently occupied by the player's piece is unoccupied and of a neutral color, then the player may move his piece through that unoccupied neutral space, and any number of interconnected, unoccupied neutral spaces connected thereto, to another unoccupied space, either neutral or otherwise, which can be reached by travelling along that path of connected neutral spaces.

3. The method of play of claim 1 including the steps of placing a stack of more than one playing piece on the designated starting space, moving the entire stack or any portion of the stack of playing pieces to any adjacent playing space; jumping on opponent's playing piece with the entire stack or any portion of the stack of playing pieces; bumping an opponent's playing piece with the entire stack or any portion of the stack of playing pieces; or building a stack by moving his playing piece or a stack of his playing pieces onto the same space during successive turns, the code of the stack being that of the top (meaning uppermost) playing piece in the stack.

4. The method of play of claim 3 wherein the playing pieces of each player are additionally coded to be either jumping pieces or bumping pieces, and includes as additional steps, any player, in turn, jumping an opponent's piece or stack of pieces only with a jumping piece or a stack the uppermost piece of which is a jumping piece and any player, in turn, bumping an opponent's piece or stack of pieces only with a bumping piece or a stack the uppermost piece of which is a bumping piece.

5. The method of play of claim 4 including the step of each player, in turn, moving his playing piece, or stack of playing pieces, through any number of contiguous, unoccupied neutrally coded playing spaces to any unoccupied playing space.

6. The method of play of claim 5 including the step of either player, in turn, rather than moving, jumping or bumping, flipping his stack over, without changing its playing space location such that the previously lowermost piece in the stack is now the uppermost piece and now dictates the code for the stack.

7. The method of play of claim 6, there is an equal number of playing spaces of each code, and double that number of spaces of the neutral code.

8. The method of play of claim 7 wherein there is an equal number of playing pieces coded similarly to each different coded playing pieces, including the neutral code.

9. The method of play of claims 1 or 8 including the additional step of first placing the playing spaces on the game board in a random manner to obtain the playing pattern.

10. The method of play of claims 1 or 8 wherein the playing pattern is a rectangular grid composed of the playing spaces.

11. The method of play of claim 10 wherein there are three additional playing spaces adjacent to each corner playing space in said rectangular grid; each said corner adjacent space being of the neutral code.

12. The method of play of claim 11 wherein one of each set of said three additional playing spaces is a designated starting space.

13. The method of play of claim 12 including the additional step of each player having allotted to him two designated player starting spaces, and each player placing all of his playing pieces which are coded as jumping pieces on one of his designated starting spaces, and all of his playing pieces coded as bumping pieces on the other of his designated starting spaces.

14. The method of play of claim 12, wherein the playing spaces and playing pieces are coded by means of color.

15. The method of play of claim 1 wherein each of the playing pieces is additionally coded as either a jumping piece or a bumping piece, and includes as additional steps, any player, in turning, jumping an opponent's piece only with a jumping piece, and any player, in turn, bumping an opponent's piece only with a bumping piece.

16. A method of play of a strategy board game in which each player moves his playing pieces about a grid of playing spaces in a playing pattern in an attempt to capture, either by jumping or bumping, the playing pieces of his opponent, the method of play comprising the steps of:

(a) each player receiving a similar set of playing pieces, the playing pieces of one player being recognizably distinct from those of another player, but the set of each consisting of an equal number of playing pieces, divided equally into two subsets, the playing pieces in each such subset coded as either jumping or bumping pieces, that is, capable of capturing an opponent's playing piece by executing either a jump from the space presently occupied by the player's piece over the adjacent space occupied by the opponent's piece and into the space directly behind the opponent's piece, or a bump from the space presently occupied by the player's piece into the adjacent space occupied by the opponent's piece, respectively, and further divided equally into more than one sub-subsets, the playing pieces within each sub-subset, in addition to being coded as a jumping or bumping piece, being additionally coded with another unique code, one of said codes being designated a neutral code;

(b) placing the playing spaces on the game board and within the grid in a random manner to produce the playing pattern, the playing spaces being equally divided into subsets, equal in number to the number of sub-subsets of the playing pieces, and coded similarly thereto;

(c) each player placing his playing pieces in stacks of multiple pieces on one or more playing spaces which have been designated as starting spaces;

(d) each player, in alternating turns, and at his discretion, moving his playing piece, or a stack of more than one playing piece, first from a designated starting space, and thereafter from its then location, to any adjacent, unoccupied playing space, or an adjacent space occupied by his own piece or pieces, regardless of codes; or (e) if an adjacent, unoccupied playing space is of a neutral code, then moving through that neutrally coded playing space and any additional contiguous, interconnected, unoccupied, neutrally coded playing spaces to any unoccupied playing space, or a space occupied by his own piece or pieces, which can be reached by travelling along those interconnected neutral spaces; or (f) if an adjacent space is occupied by an opponent's playing piece or stack of playing pieces, and, if that adjacent playing space is similarly coded as the player's playing piece or the uppermost playing piece in a stack of playing pieces, or if either said adjacent playing space or the player's playing piece or the uppermost playing piece in his stack of playing pieces, is of the neutral code, and if the player's playing piece, or the uppermost playing piece in a stack of playing pieces, is coded as a bumping piece, then the player may capture the opponent's playing piece or stack of playing pieces by moving his playing piece, or his stack of playing pieces, or a top portion of his stack of playing pieces onto the playing space formerly occupied by the captured opponent's playing piece or stack of playing pieces and may remove his opponent's captured playing piece or pieces from the game board; or (g) if an adjacent playing space is occupied by an opponent's playing piece or a stack of playing pieces, and if the playing space directly and linearly behind (relative to the player's playing piece) and adjacent to the playing space now occupied by the opponent's playing piece or stack of playing pieces is unoccupied, and if that unoccupied playing space is coded similarly to the sub-subset code of the player's playing piece or the uppermost playing piece of a stack of playing pieces, or if either that unoccupied playing space or the player's playing piece or the uppermost playing piece of a stack of playing pieces is of the neutral code, and the player's playing piece or the uppermost playing piece of a stack of playing pieces is coded as a jumping piece, then the player may capture the opponent's said playing piece of stack of playing pieces by jumping over the opponent's said piece or pieces onto said unoccupied playing space, and continuing, within the same turn, to make multiple jumps if the above stated conditions exist as to each jump; or (h) if an opponent's playing piece or stack of playing pieces may be reached as a result of moving through an adjacent unoccupied neutrally coded playing space, and any number of inter-connected such playing spaces, and if the above stated conditions for a jump or a bump exist with respect to that opponent's playing piece or stack of playing pieces, the jump or bump may be executed, in that same turn, after moving through the unoccupied, interconnected neutrally coded playing spaces; or (i) in any one turn, and as a complete move, either player flipping any stack of his playing pieces over such the previously lowermost playing piece in the stack is now the uppermost piece; and (j) continuing in that manner until one player has captured a predetermined number of his opponent's playing pieces.

17. The method of play of claim 16 including the additional step of first placing the playing spaces in the grid on the game board in a random manner to obtain the playing pattern.

* * * * *